US007025179B2

(12) United States Patent
Shih

(10) Patent No.: US 7,025,179 B2
(45) Date of Patent: Apr. 11, 2006

(54) EMERGENCY EVACUATION SYSTEM FOR AN ELEVATOR

(76) Inventor: Kuei-Tang Shih, No. 45, Nong 12, Lane 108, Youg-Feng, Tai-Reig Hsiang, Taichung (TW)

( * ) Notice: Subject to any disclaimer, the term of this patent is extended or adjusted under 35 U.S.C. 154(b) by 253 days.

(21) Appl. No.: 10/640,207

(22) Filed: Aug. 12, 2003

(65) Prior Publication Data

US 2005/0034930 A1 Feb. 17, 2005

(51) Int. Cl.
*B66B 13/02* (2006.01)

(52) U.S. Cl. ..... 187/313; 187/290; 187/298

(58) Field of Classification Search ..... 187/250, 187/254, 391–396, 263, 316, 313, 314, 288, 187/414, 325, 298, 290, 306
See application file for complete search history.

(56) References Cited

U.S. PATENT DOCUMENTS

| | | | | |
|---|---|---|---|---|
| 5,740,888 | A * | 4/1998 | Aulanko et al. | 187/336 |
| 6,264,005 | B1 * | 7/2001 | Kang et al. | 187/290 |
| 6,302,240 | B1 * | 10/2001 | Shih | 187/414 |
| 6,405,834 | B1 * | 6/2002 | Chida et al. | 187/391 |
| 6,471,014 | B1 * | 10/2002 | Daniel et al. | 187/391 |
| 6,494,296 | B1 * | 12/2002 | Lindegger et al. | 187/393 |

* cited by examiner

*Primary Examiner*—Jonathan Salata
(74) *Attorney, Agent, or Firm*—Charles E. Baxley

(57) ABSTRACT

An emergency safeguard system for elevator includes an emergency push-button disposed in the elevator car applied to cooperate with an auxiliary control panel and an auxiliary door opening system, furthermore, on the elevator car and in the elevator shaft are provided with photoinduced system and positioning and direction judging system, such that the stranded users are able to extricate themselves from the elevator car under an automatic and safety program.

6 Claims, 4 Drawing Sheets

EMERGENCY EVACUATION SYSTEM FOR AN ELEVATOR

FIELD OF THE INVENTION

The present invention relates to an emergency evacuation system for an elevator, which includes an emergency push-button disposed in the elevator car for working with an auxiliary control panel as well as an auxiliary door opening system so as to alternatively use a standby power system, furthermore, on the elevator car and in the elevator shaft are provided with photoinduced system and positioning and direction judging system respectively, such that the users are able to extricate themselves from the elevator car under an automatic and safety program.

DESCRIPTION OF THE PRIOR ARTS

A conventional elevator car safety system normally includes an emergency button disposed in an elevator car and the button is connected with the alarm bell in the guardroom, and the user can ask for help by pressing the emergency button in case of being stuck in elevator. This elevator car safety system has been used for a long time, however, there are still some disadvantages that need to be improved as follows:

First, since the height that the elevator car stops is unknown and cannot be decided, it will be very dangerous if the rescuers open the elevator door before the position of the elevator car is decided, in this case, the person to be stuck in the elevator have to wait in the elevator car for help or crawl out from the emergency door. However, due to the person to be stuck in the elevator don't know the height that the elevator car is located, it will be very dangerous for them to crawl out via the emergency door. On the other hand, the user should not wait in the elevator car if earthquake or fire happens outside, the result will be unpredictable.

Second, if the elevator is our of order, the brake of the dynamic system will automatically stops the elevator and the user is stuck between floors they have to crawl up or down for a certain distance to reach the nearest door of the elevator shaft, and if the elevator stops at a very high position, it will be very dangerous for the user to crawl down or up to the nearest floor by themselves.

Third, if the elevator is our of order, the elevator car may stop at a height over the top floor or lower than the lowest floor, in this case, the person to be stuck in the elevator are unable to extricate themselves from the elevator car.

The present invention has arisen to mitigate and/or obviate the afore-described disadvantages of the conventional emergency evacuation system for an elevator.

SUMMARY OF THE INVENTION

The primary object of the present invention is to provide an emergency evacuation system for an elevator, which includes an emergency push-button disposed in the elevator car applied to cooperate with an auxiliary control panel and an auxiliary door opening system, such that is able to alternatively use the standby power system, furthermore, on the elevator car and in the elevator shaft are provided with photoinduced system and positioning and direction judging system respectively, such that the users are able to extricate themselves from the elevator car under an automatic and safety program.

Another object of the present invention is to provide an emergency evacuation system for an elevator that is capable of providing an optimal operation for helping the user to escape from the elevator car so long as the user presses an emergency push-button in the elevator car.

The present invention will become more obvious from the following description when taken in connection with the accompanying drawings, which shows, for purpose of illustrations only, the preferred embodiments in accordance with the present invention.

DETAILED DESCRIPTION OF THE PREFERRED EMBODIMENTS

Figure 1:
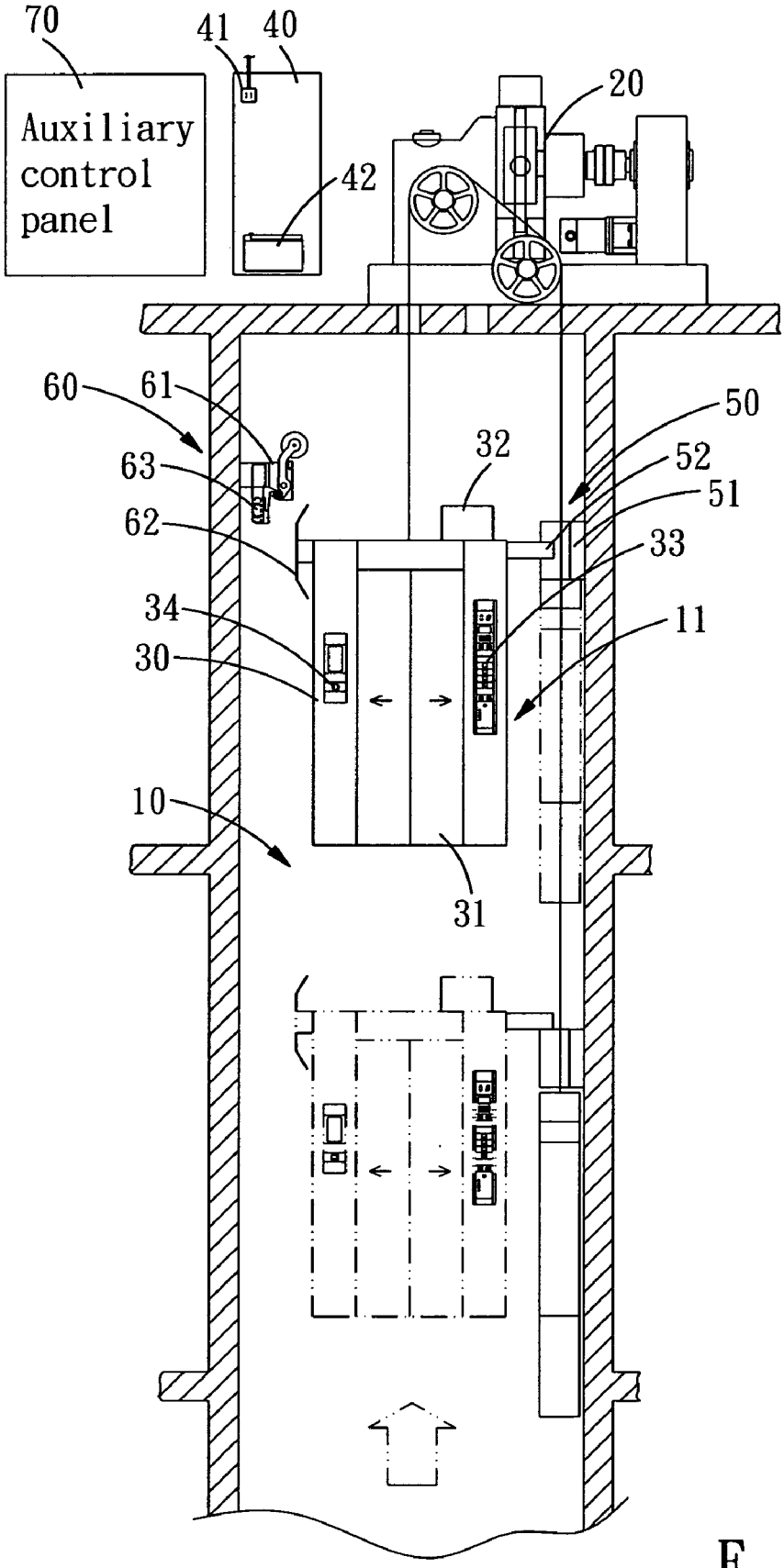
FIG. 1 is a cross sectional view of showing a hardware configuration of an emergency evacuation system for an elevator of the present invention.
Figure 2:
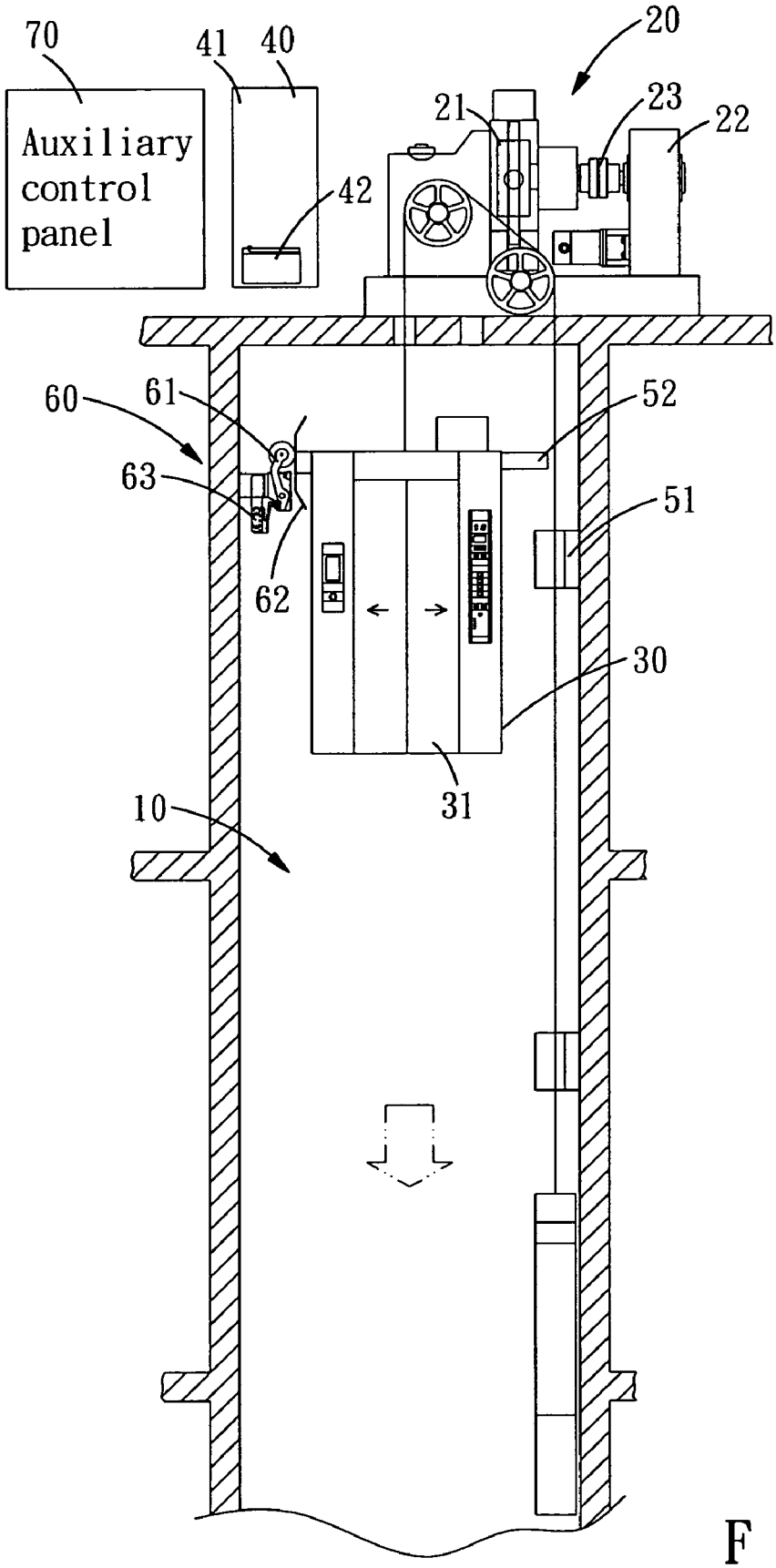
FIG. 2 is another cross sectional view of showing a hardware configuration of the emergency evacuation system for an elevator of the present invention.
Figure 3:
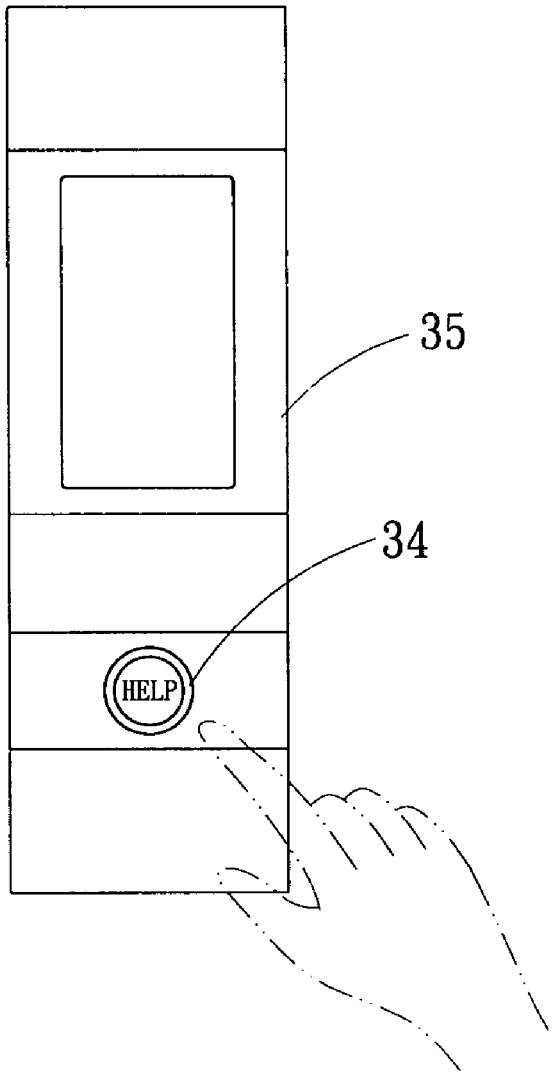
FIG. 3 is an illustrative view of showing an emergency push-button of the present invention.
Figure 4:
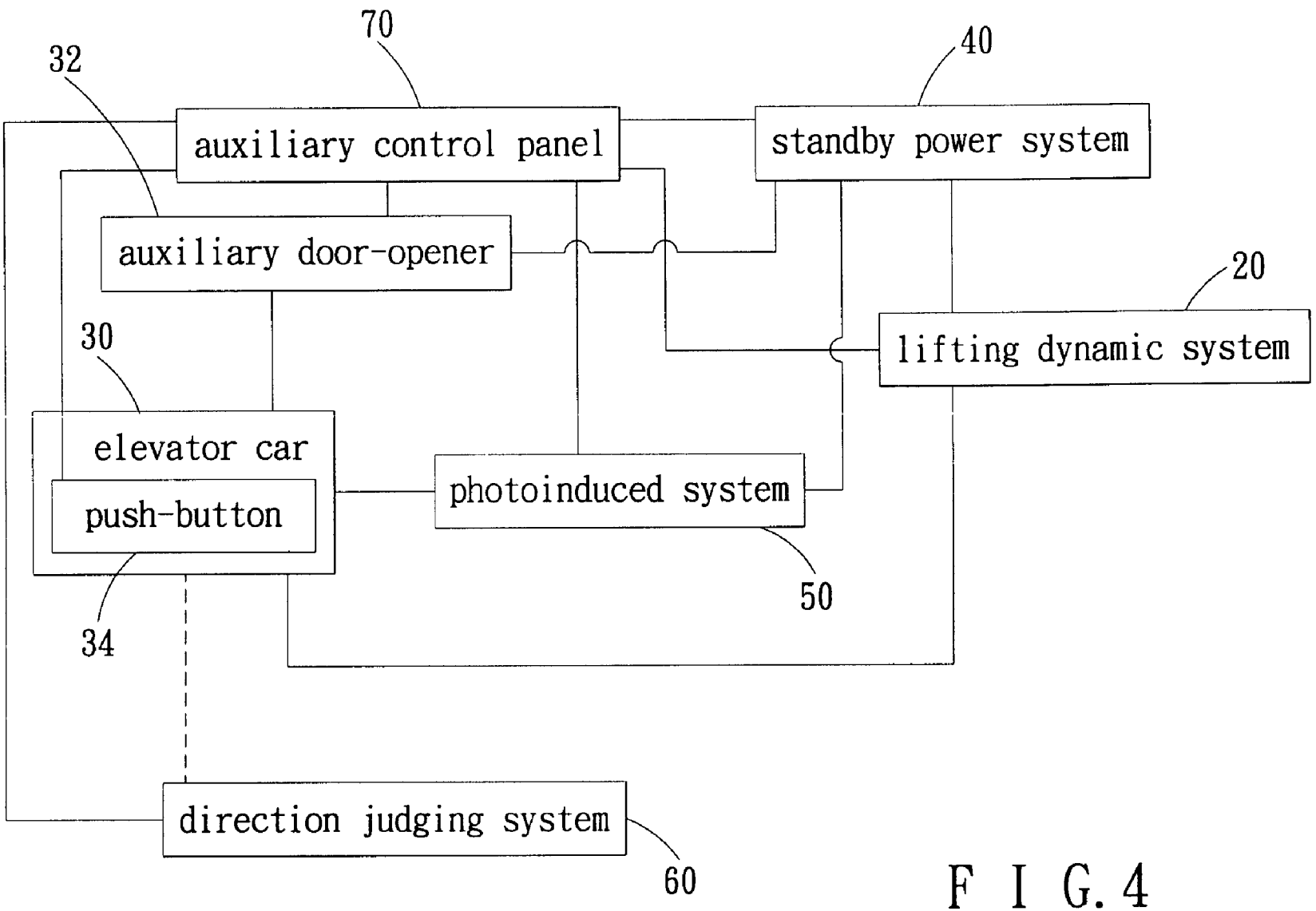
FIG. 4 is a schematic block diagram of the emergency evacuation system for an elevator of the present invention.

Referring to FIGS. 1–4, in which, FIGS. 1–3 are schematic illustrative view of the hardware configuration of the present invention, and FIG. 4 is a schematic block diagram of the emergency evacuation system for an elevator. The emergency evacuation system of an elevator in accordance with the present invention generally includes an elevator shaft 10, a lifting dynamic system 20, an elevator car 30, a standby power system 40, a photoinduced system 50, a positioning and direction judging system 60 and an auxiliary control panel 70.

The elevator shaft 10 is an elongated space preformed in a building and is provided with a door 11 at each floor of the building.

The lifting dynamic system 20 is disposed in the elevator shaft 10 and comprises: a main dynamic unit 21 and a standby dynamic unit 22. Both the main dynamic unit 21 and the standby dynamic unit 22 can work independently and separately, furthermore, an electromagnetic clutch 23 is applied the main dynamic unit 21 and the standby dynamic unit 22 for connecting them together.

The elevator car 30 is driven by the lifting dynamic system 20 and movably disposed in the elevator shaft 10. At a side of the elevator car 30 is provided with an elevator door 31 for cooperating with the door of the elevator shaft 10. An auxiliary door-opener 32 is provided at a side of the elevator door 31, and in the elevator car 30 is provided a control panel 33 for controlling the lifting dynamic system 20. In addition an indicator board 35 is provided in the elevator car 30 and can generate lights, and on the indicator board 35 is arranged an emergency push-button 34 with light-generating ability.

The standby power system 40 includes a direct current supply 41 and a battery power 42. The direct current supply 41 and the battery power 42 can be used alternatively under the control of the emergency push-button 34 of the elevator car 30, furthermore, both of the direct current supply 41 and the battery power 42 are connected to the standby dynamic unit 22 of the lifting dynamic system 20 as well as the auxiliary door-opener 32 of the elevator car 30.

The photoinduced system 50 includes a plurality of shade screens 51 and plural photoinduced switches 52. The shade screens 51 are provided on the elevator car 30 and the respective shade screens 51 are disposed in the elevator shaft 10.

The positioning and direction judging system 60 includes an upper limit switch 61, a downconverter 63 and a contact panel 62. The contact panel 62 is disposed on the elevator car 30, the upper limit switch 61 and the downcoverter 63 are correspondingly disposed in the elevator shaft 10. The upper limit switch 61 is able to actuate the downcoverter 63.

The auxiliary control panel 70 is controlled by the standby power system 40, and is interiorly provided with predetermined program controlling elements. The auxiliary control panel 70 is connected with the photoinduced system 50, central control system (guardroom of the building) and the positioning and direction judging system 60 and is under control of the emergency push-button 34. The emergency push-button 34 will co-work with the auxiliary control panel 70 to generate lights. Furthermore, the downconverter 63 of the positioning and direction judging system 60 is connected with the auxiliary control panel 70.

At a normal running condition, the user in the elevator car 30 is able to use the control panel 33 to control the main dynamic unit 21 of the lifting dynamic system 20, so as to make the elevator car 30 move up and down or stop in the elevator shaft 10.

When the elevator has a breakdown (power failure of the elevator, the main dynamic unit or the mail control system are out of order), the elevator 30 will stop in the elevator shaft instantly (emergency auto-braking apparatus has been applied to all kinds of conventional elevator, so further remarks on this matter would be seem superfluous), at this moment, the main dynamic unit 21 and the main power will stop automatically. The auxiliary control panel 70 and the standby power system 40 would be turned on automatically upon the implementation of the emergency brake action, furthermore, the auxiliary control panel 70 will instantly be connected to the central control system, notifying the guardroom of the building that someone is stuck in the elevator car. At the same time, the auxiliary control panel 70 will enable the emergency push-button 34 in the elevator car 30 to create lights so as to instruct the user in the elevator car 30 to press the emergency push-button 34. After the user pushes the emergency push-button 34, the auxiliary control panel 70 will immediately determine the position of the elevator car 30 by virtue of the cooperation of the photoinduced system 50 with the positioning and direction judging system 60, the method for position-detecting will be explained as flowed:

First, the photoinduced system 50 tells if the position of the elevator car 30 is over the setting height. If at the normal position (right facing to the door 11 of the elevator shaft 10), the auxiliary control panel 70 will use the standby power system 40 to drive the auxiliary door opener 32 to open the elevator door 31 of the elevator car 30, thus extricating the user out of the elevator car.

Second, when the elevator car 30 stuck between the floors, the positioning and direction judging system 60 will tell the auxiliary control panel 70 about the relative position of the elevator car 30 in the elevator shaft 10. And then the auxiliary control panel 70 will instruct the standby power system 40 and the standby dynamic unit 22 of the lifting dynamic system 20 to raise the elevator car 30 to the nearest floor. Finally, the auxiliary control panel 70 will instruct the auxiliary door opener 32 to open the elevator door 31 of the elevator car 30. By this way, the stranded users are able to escape via the door 11 of the elevator shaft 10 at the nearest floor.

Third, when the elevator car 30 goes beyond the top floor or lower than the lowest floor, the positioning and direction judging system 60 will inform the auxiliary control system 70 that the position of the elevator 30 is over the setting height (or over the top floor or lower than the lowest floor), and then the auxiliary control panel 70 will instruct the standby power system 40 and the standby dynamic unit 22 of the lifting dynamic system 20 to make the elevator car 30 move up-and-down along the predetermined direction (the elevator car 30 will raise up or fall down to the nearest floor when it is over the top floor or lower the lowest floor). Finally, the auxiliary control panel 70 will instruct the auxiliary door opener 32 to open the elevator door 31 of the elevator car 30. By this way, the stranded users are able to escape via the door 11 of the elevator shaft 10.

Thereby, when the users stuck in the elevator of the present invention, the emergency push-button 34 will flash and remind the users to escape from the elevator safely just by using the control.

It will be noted that the shade screens 51 and the photoinduced switches 52 of the position-detecting and determining operation of the photoinduced system 50 are disposed in the elevator car 30 and the elevator shaft 10. The shade screens 51 are able to detect the height of the elevator car 30 by cooperating with the photoinduced switches 52 on the elevator car 30. In addition, at the normal running condition, the upper limit switch 61 will cooperate with the main control system to detect the position of the elevator car 30. However, when the auxiliary control panel 70 is operating, the upper limit switch 61 will actuate the downconverter 63, and thus the upper limit switch 61 and the downconverter 63 will be contacted directly by the elevator car 30, enabling the positioning and direction judging system 60 to inform the auxiliary control panel 70 immediately whether the position of the elevator car 30 is beyond the setting position (over the top floor or lower than the lowest floor) and to make the auxiliary control panel 70 decide the moving direction of the elevator.

While we have shown and described various embodiments in accordance with the present invention, it should be clear to those skilled in the art that further embodiments may be made without departing from the scope of the present invention.

What is claimed is:

1. An emergency evacuation system for an elevator comprising:

an elevator shaft preformed in a building and provided with a plurality of doors located correspondingly to a position of each floor of the building;

a lifting dynamic system defined in the elevator shaft;

an elevator car driven by the lifting dynamic system and movably disposed in the elevator shaft, at a side of the elevator car provided with an elevator door corresponding to the door of the elevator shaft, an auxiliary door-opener provided at a side of the elevator door, in the elevator car defined with a control panel for controlling the lifting dynamic system of the elevator;

the characteristic of the present invention lies in:

an emergency push-button is provided in the elevator car;

a standby power system is under control of the emergency push-button and connected with the lifting dynamic system as well as the auxiliary door-opener of the elevator car;

a photoinduced system includes plural shade screens and photoinduced switches that are correspondingly disposed on the elevator car and in the elevator shaft;

an auxiliary control panel is under control of the standby power system and interiorly provided with predetermined program controlling elements, the auxiliary control panel is connected with the photoinduced system and the positioning and direction judging system, and under control of the emergency push-button.

2. The emergency evacuation system for an elevator as claimed in claim 1, wherein the emergency push-button co-works with the auxiliary control panel to create lights.

3. The emergency evacuation system for an elevator as claimed in claim 1, wherein the auxiliary control panel will be synchronously connected to the guardroom of the building when it is turned on.

4. The emergency evacuation system for an elevator as claimed in claim 1, wherein the lifting dynamic system includes a main dynamic unit and a standby dynamic unit, both of the main dynamic unit and the standby dynamic unit can work independently and separately, furthermore, an electromagnetic clutch is disposed therebetween for connecting them together.

5. The emergency evacuation system for an elevator as claimed in claim 1, wherein the emergency push-button of the elevator car is defined on an indicator board, furthermore, the indicator board cooperates with the auxiliary control panel and creates lights.

6. The emergency evacuation system for an elevator as claimed in claim 1, wherein the positioning and direction judging system includes upper limit switch, downconverter and contact panel, the contact panel is disposed on the elevator car, the upper limit switch and the downconverter are disposed in the elevator shaft and located correspondingly to the contact panel on the elevator car, the upper limit switch is capable of actuating the downconverter during the operation of the auxiliary control panel.

* * * * *